US006769205B1

(12) United States Patent
Steidle

(10) Patent No.: US 6,769,205 B1
(45) Date of Patent: Aug. 3, 2004

(54) PAD FOR AN IRONING SURFACE AND METHOD OF MAKING THE SAME

(75) Inventor: Robert M. Steidle, Devon, PA (US)

(73) Assignee: Shen Manufacturing Company, Incorporated, West Conshohocken, PA (US)

( * ) Notice: Subject to any disclaimer, the term of this patent is extended or adjusted under 35 U.S.C. 154(b) by 0 days.

(21) Appl. No.: 10/351,206

(22) Filed: Jan. 24, 2003

Related U.S. Application Data

(63) Continuation of application No. 10/029,761, filed on Oct. 29, 2001, now Pat. No. 6,536,144.
(60) Provisional application No. 60/314,173, filed on Aug. 22, 2001.

(51) Int. Cl.[7] ..... D06F 83/00
(52) U.S. Cl. ..... 38/137
(58) Field of Search ..... 38/137, 140, 66; 112/475.08, 420, 402, 412, 24, 23; 428/37, 102, 105, 113, 118, 190, 191, 292.1, FOR 100, FOR 101, FOR 102, FOR 105

(56) References Cited

U.S. PATENT DOCUMENTS 1,826,395 A * 10/1931 Galvin ..... 38/66
1,998,807 A 4/1935 Galvin
2,178,633 A * 11/1939 Hooper ..... 29/423
2,225,874 A * 12/1940 Lehrman ..... 66/191
2,741,045 A 4/1956 Merkin
3,049,826 A 8/1962 Goldsmith
3,057,179 A 10/1962 Willingham
3,097,442 A 7/1963 Willingham
3,649,428 A * 3/1972 Hughes ..... 428/91
3,911,603 A 10/1975 Lehrman
4,043,062 A 8/1977 Lehrman
4,360,984 A 11/1982 Ruttenberg
4,603,494 A 8/1986 Lehrman
5,371,961 A 12/1994 Mattesky
5,799,600 A * 9/1998 Reuben ..... 112/420
5,894,690 A 4/1999 Lehrman
6,536,144 B2 * 3/2003 Steidle ..... 38/140

* cited by examiner

*Primary Examiner*—Ismael Izaguirre
(74) *Attorney, Agent, or Firm*—John F. A. Earley; John F. A. Earley, III; Harding, Earley, Follmer & Frailey

(57) ABSTRACT

An ironing board pad having a plurality of fibrous elements arranged adjacently and held together by a web with a plurality of loops forming a network to hold the fibrous elements in compressive adjacent relation to one another, the web being made of a heat resistant material.

14 Claims, 3 Drawing Sheets

PAD FOR AN IRONING SURFACE AND METHOD OF MAKING THE SAME

CROSS-REFERENCE TO RELATED APPLICATIONS

This application claims priority to U.S. application Ser. No. 10/029,761, filed on Oct. 29, 2001, now U.S. Pat. No. 6,536,144 and is a continuation thereof, and claims priority to Provisional Application Serial No. 60/314,173, filed on Aug. 22, 2001.

BACKGROUND OF THE INVENTION

1. Field of the Invention

The present invention relates to the field of ironing board pads and a method for constructing an ironing board pad, and more particularly, to an improved ironing board pad which has improved resistance to wrinkling, and improved heat retaining properties.

2. Brief Description of the Related Art

The use of ironing board apparatus is well known in the art. Typically, an ironing board is constructed by providing a surface which supports garments during ironing. The ironing board surface generally is covered. Ironing board covers typically consist of a padding underlying layer and a fabric top layer. The underlayer comes in contact with the ironing board surface, whereas the top layer comprises the ironing surface and comes into contact with the clothing articles placed thereon. Known ironing board covers employ heat resistant fabrics. The underlying layer is sometimes referred to as a pad, which is separately provided. However, in other instances, for example, the padding layer may be joined with the top layer by an adhesive. One example of an ironing board cover is shown in U.S. Pat. 3,911,603, where a padding layer is sized the same as the board to be covered and the fabric layer is larger than the padding layer so that a marginal integral skirt is defined between the edges of the padding and the edge of the fabric layer. Alternately, the padding layer can be coextensive with the fabric layer.

Generally, the shape of the ironing board cover is configured to match the shape of the ironing board. The shape of the ironing board cover is for the most part oversized to cover the ends and edges of the board. The ironing board cover generally is folded around the edges of the board. The cover is usually held onto the board with drawstrings which are located on the margin of the cover and can be drawn to secure the cover on the board.

When a garment article is ironed, a force is generally applied to press out wrinkles. The force is a compressive force exerted by an iron which presses the garment on the cover. Often, the force exerted on the ironing board cover can cause wrinkling of the cover. Either the top fabric layer, or the underlying layer, such as a padding layer, can become dislodged or bunched during ironing. The problem of resistance to wrinkling and improved burst strength was recognized in U.S. Pat. No. 5,894,690, for a "Reinforced Ironing Board Cover", issued on Apr. 20, 1999 to David Lehrman. The '690 patent provides a cover comprising a layer of fabric, a layer of padding, and a thermoplastic polymer sheet there between.

When ironing garments, it is desirable to have steam freely pass through the garment and the cover on the ironing board and into the underlying pad. The free passage of the steam allows circulation of the steam and facilitates ironing of the garment. U.S. Pat. No. 5,371,961 for a "Pad and Sheet Tacking in Ironing Board Cover"

U.S. Pat. No. 3,049,826 for an "Ironing Board Cover" provides an asbestos-impregnated woven textile.

U.S. Pat. No. 4,043,062 discloses an ironing pad for table-top use. A skid resistant coating is included on the widerside of the pad, but not on the ironing surface. U.S. Pat. No. 4,360,984 discloses a similar table-top ironing pad having a cotton cover coated with a synthetic resin, but the resin is intended to improve heat resistance and minimize, rather than maximize, friction between the ironed articles and the pad.

However, certain prior art covers have been found to have other problems, such as failing to protect against slippage of articles placed thereon during ironing.

U.S. Pat. No. 4,603,494 for a "Non-Skid Ironing Board Cover" attempts to provide a skid-resistant type ironing board.

The prior art recognizes certain drawbacks known to occur with ironing board covers, such as slippage of garments from the top cover, bunching of the covers while ironing, as well heat loss. However, there is still a need for an improved ironing board cover, which facilitates pressing of garments, and which avoids the drawbacks of the prior covers used in the past.

SUMMARY OF THE INVENTION

The present invention provides a pad for an ironing board surface and a method for making an improved pad. The pad is constructed from a heat resistant material. Preferably, cotton is used. The pad is configured from an arrangement of the cotton material. The pad also has pockets, straps or other suitable elements for attachment of the pad to an ironing board. The pad is configured to prevent wrinkling of the pad during ironing and to improve the heat transfer to the garment from the pressing device or iron.

It is an object of the present invention to provide a novel ironing board pad which has improved resistance to wrinkling and bunching during ironing.

It is another object of the present invention to provide a novel ironing board pad which has improved ability to retain heat on the surface of the pad.

It is a further object of the present invention to provide a novel ironing board pad which facilitates the prevention of grid lines or other patterns of the ironing board surface being impressed into garments ironed with the use of the pad installed on the board surface.

It is a further object of the present invention to provide a method for making an ironing board pad having improved resistance to wrinkling and bunching during ironing.

It is a further object of the present invention to provide a method for making an ironing board pad having improved ability to retain heat on the surface of the pad.

BRIEF DESCRIPTION OF THE DRAWING FIGURES

Figure 1:
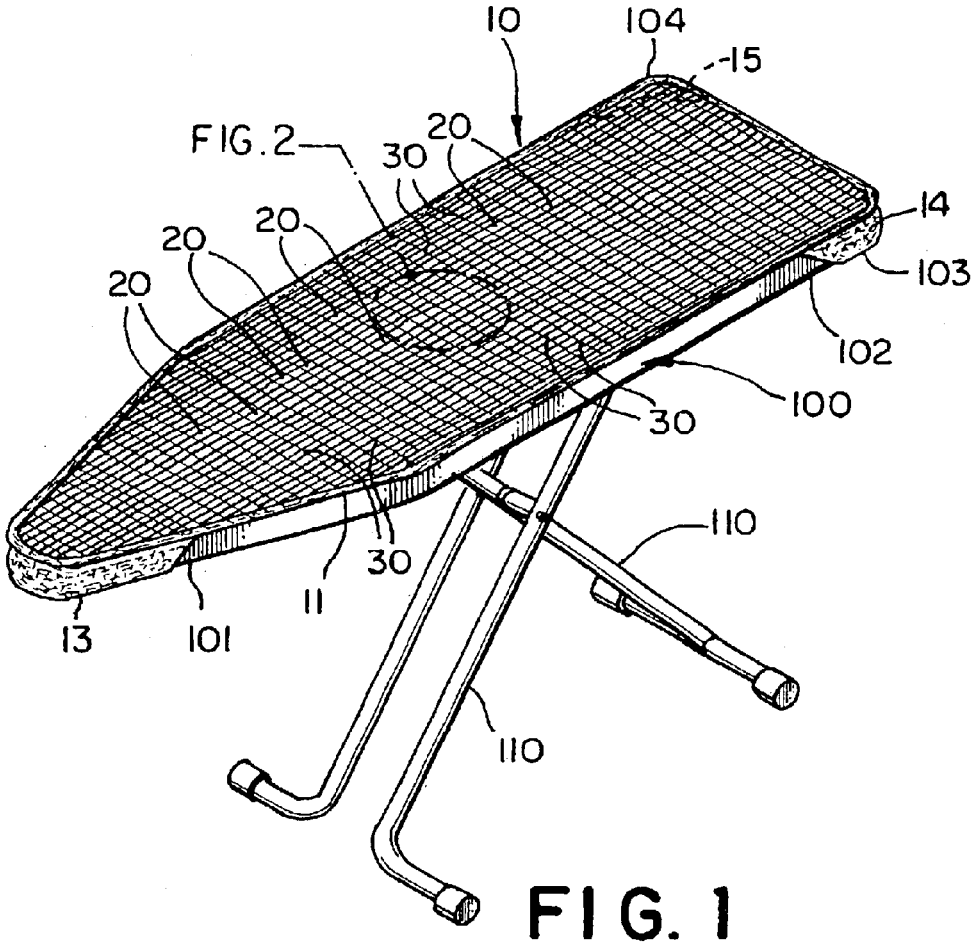
FIG. 1 is a perspective view of a first embodiment of an ironing board pad constructed in accordance with the present invention.
Figure 5A:
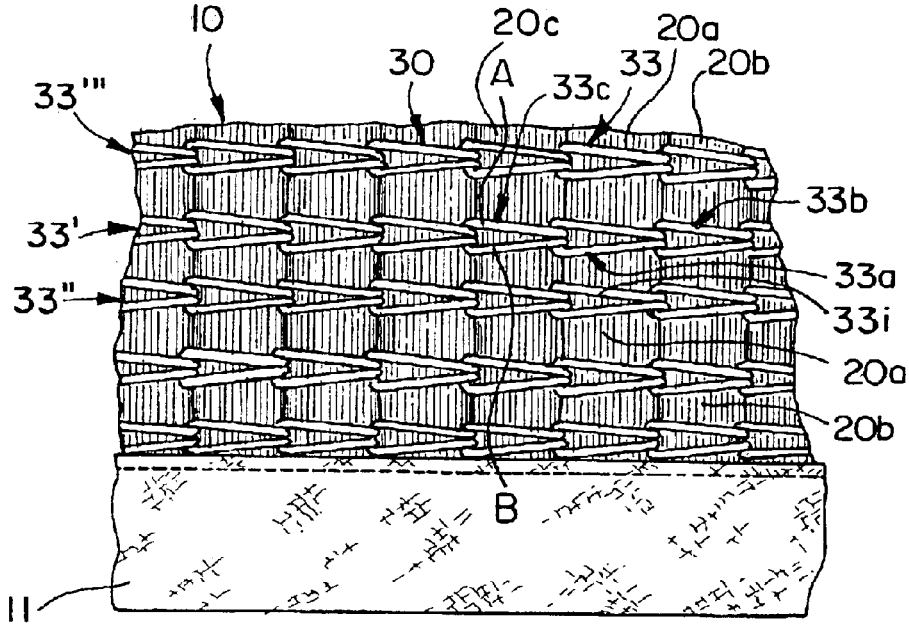

FIG. 5*a* is an enlarged top plan view of a section of the ironing board pad of FIG. 1, showing the weave configuration.

Figure 5B:
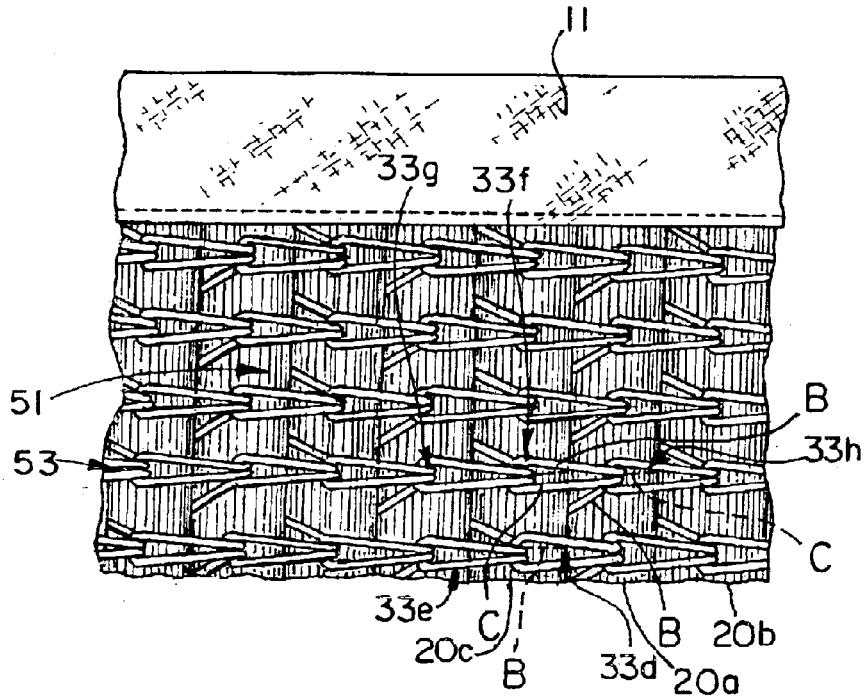

FIG. 5*b* is an enlarged bottom plan view of a section of the ironing board pad of FIG. 1, showing the weave configuration.

DESCRIPTION OF THE PREFERRED EMBODIMENTS

Reference now being made to the drawings, an ironing board pad 10 constructed in accordance with the present invention is shown. The ironing board pad 10 has attachment means for attaching the pad 10 to an ironing board 100. The pad 10 has a binding 11 disposed on its edges. Preferably, the binding 11 is comprised of a heat resistant material, which can be cotton.

The attachment means can comprise any suitable means for attaching the pad 10 to an ironing board 100. The ironing board 100 has foldable legs 110 for supporting the board surface. In the preferred embodiment of the pad 10 shown in FIG. 1, the attachment means comprises pockets 13, 14, and 15. The front pocket 13 is provided on the bottom of the pad 10 to secure the pad 10 to the front end 101 of an ironing board 100 by fitting over the board front end 101. The rear pockets include a first rear pocket 14 and a second rear pocket 15 which are provided on the bottom of the pad 10 for securing the pad 10 to the back end 102 of an ironing board 100. The back end 102 of the ironing board 100 generally has two corners 103, 104 to which the rear pockets 14, 15 attach. Preferably, the pockets 13, 14, and 15 are formed from a material which is attached to the bottom of the pad 10, preferably at the perimeter thereof As shown in FIG. 1, the pockets 13, 14, and 15 are secured along the edge of the pad 10 with the binding 11, with at least one side of each pocket 13, 14, 15 being free to provide an opening for receipt of a respective board end 101, 102 therein. The pad 10 is positioned over an end of the ironing board 100, either the front end 101 or back end 102, so that at least one board end is received in its corresponding pocket, either the front pocket 13, or the first and second rear pockets 14 and 15. Once one end of the board 100 is positioned in a pocket, the pad 10 is stretched to fit the remaining pocket or pockets on the opposite board end. It is preferred that there be some tension when, the pad 10 is installed on the board 100 to facilitate retention of the pad 10 on the board 100 during ironing.

While the attachment means is shown comprising pockets 13, 14, and 15, it will be understood that the attachment means can comprise any suitable means for securing the pad 10 to an ironing board, such as a drawstring, band or the like.

Figure 3:
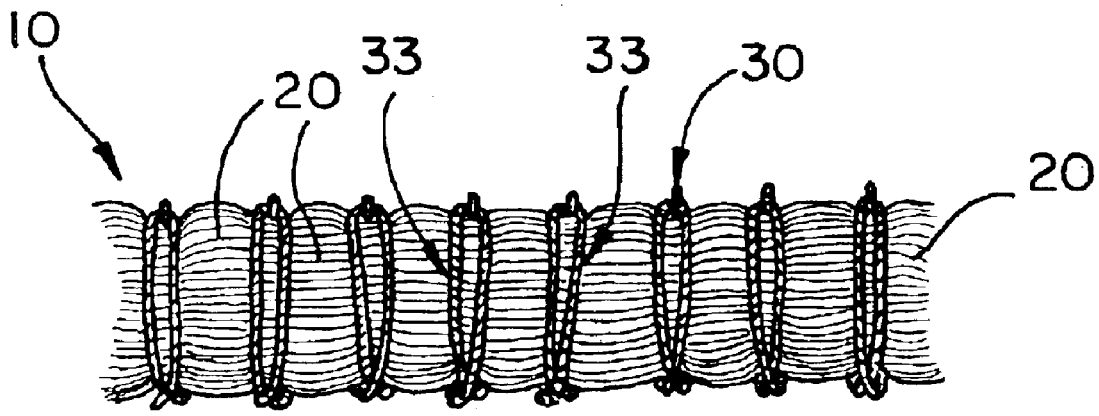
FIG. 3 is an enlarged partial sectional view of the ironing board pad shown in FIGS. 1 and 2, taken along the line 3—3 of FIG. 2, and viewed from the front of the pad.

The pad 10 is preferably comprised of a fibrous material which is heat resistant. Preferably, the fibrous material comprises cotton. Cotton is heat resistant and withstands the high temperatures encountered by the iron and steam generated from the iron. The cotton composing material is preferably configured in an arrangement, as shown in FIG. 3. Preferably, the pad 10 is comprised of a plurality of fibrous elements or slivers 20 comprising fibrous material. The slivers 20 are arranged adjacently, and, as shown, may be transversely provided in relation to the length of the pad 10. Each sliver 20 is preferably comprised of a densely compressed filament or fiber, such as cotton. The compressed cotton sliver 20 is held in place by a web 30. The sliver 20 generally is provided having a larger preassembly volume than its final volume when assembled to form the pad 10. In accordance with a preferred embodiment of the present invention, the sliver 20 is positioned to be held by the web 30, and undergoes compression, or further compression when it is assembled to form the pad 10. For example, the sliver 20 may be positioned on a loom (not shown) and thread woven to form the network of loops 33 to hold the sliver 20, and additional slivers 20 to form the pad 10.

Preferably, the pad 10 has a front end, a rear end, a top surface and a bottom surface, with the fibrous elements or sliver 20 being arranged to form the pad 10. Preferably, the fibrous elements or slivers 20 are disposed in adjacent relation to one another and are arranged transversely between the front end and rear end of the pad 10, as shown in FIG. 1. In the preferred embodiment shown, the slivers 20 span between the right side of the pad 10 and the left side of the pad 10.

Figure 2:
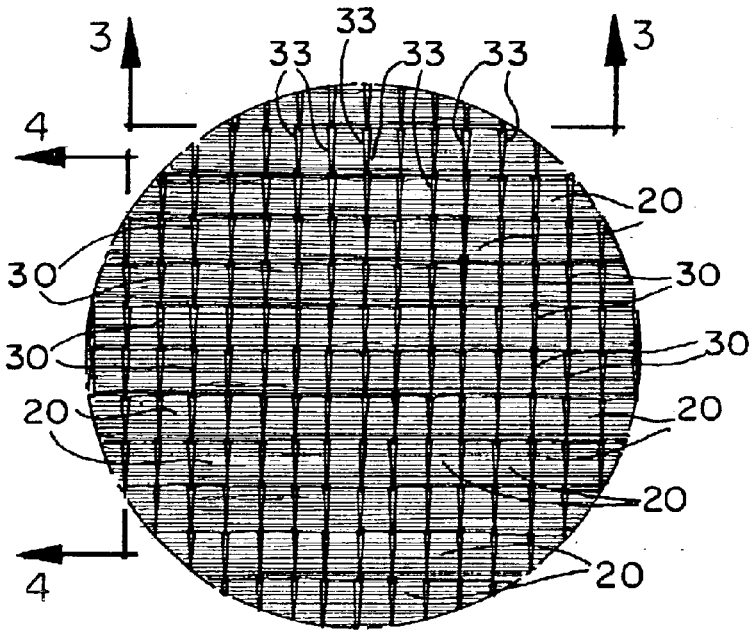
FIG. 2 is an enlarged top plan view of a portion of the pad represented in the circled area of FIG. 1.
Figure 4:
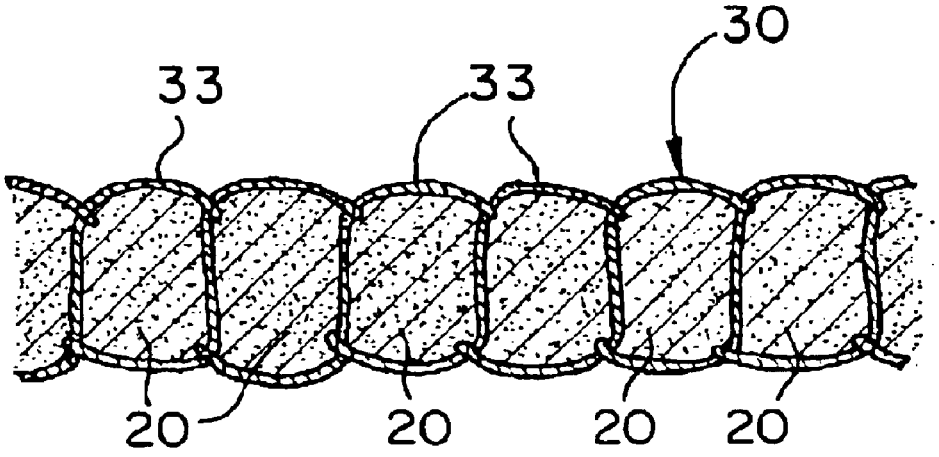
FIG. 4 is an enlarged partial sectional view of the ironing board pad shown in FIGS. 1–3, taken along the line 4—4 of FIG. 2 and viewed from the left side of the pad.

The web 30 comprises a plurality of loops 33 forming a network to hold the fibrous elements or slivers 20 in compressive adjacent relation to one another. In FIGS. 2, 5*a* and 5*b* a plurality of slivers 20 is shown, each being adjacently disposed to another. The web 30 is comprised of a heat resistant material since it is subject to the heat which the slivers 20 also encounter. The web 30 preferably is configured from a longitudinal weave of loops 33 which lasso and hold the slivers 20 in adjacent relation to one another. The loops 33 also are maintained to apply a force to constrict the fibrous sliver elements 20 and maintain them in a compressed condition. The density of the slivers 20 is facilitated by the compression of the web 30 against the slivers 20. The web 30 preferably is constructed from a network of threads which are woven to form a plurality of loops 33. Referring to FIGS. 3 and 4, in accordance with the preferred embodiment of the invention, the strand portions forming each loop 33 partially or completely encircle a fibrous element or sliver 20 to facilitate holding the slivers 20.

Referring to FIGS. 5*a* and 5*b*, the loops 33 preferably are longitudinally disposed and are spaced apart from each other both adjacently, and longitudinally where loops 33 interconnect with each other. In accordance with the preferred embodiment, each loop, such as, for example, the loop identified as a first upper loop 33*a*, preferably engages with longitudinally proximate second and third upper loops 33*b* and 33*c*. As shown, preferably, there is formed a first series of loops 33' which includes the longitudinally disposed loops 33*a*, 33*b* and 33*c*, and spans longitudinally from one end of the pad 10 to the other end of the pad 10.

A preferred configuration of loops 33 is illustrated in the drawing figures. The slivers 20 preferably are arranged in transverse relation to the longitudinally positioned loops 33. Each longitudinal series of loops, such as for example the first series of loops 33', is spaced from an adjacent longitudinal series of loops, such as for example, the second series of loops 33", the third series of loops 33''', to form the web 30.

The loops 33 are configured to lasso the silvers 20. In a preferred embodiment, illustrated in the drawing figures, a loop 33 is formed by a strand of a heat resistant line or thread. An example of a loop 33*a* is shown and described, and it will be understood that other loops forming the web 30 can comprise the same configuration as that discussed in relation to the loop 33*a*. The first loop 33*a* engages a serially successive loop 33*b* which, together with other loops, form the web network. The loops 33*a* and 33*b* are tightened to compress the sliver 20*a* and maintain the sliver 20*a* in its compressed condition. The other loops 33 are also compressed by tightening when the pad 10 is formed to maintain the slivers 20 in compression. The tightening of the loops 33 is preferably, may be done as the pad 10 is being constructed, such that, for example, as each sliver 20 is positioned for addition to the pad 10 being formed, the loops 33 holding the sliver 20 are tensioned with a suitable tensioning device, such as a loom or knitting apparatus.

Referring to FIG. 5*a,* the top of the pad 10 is shown. Each loop 33, such as is illustrated by the upper loop 33*a,* is shown lassoing a serially next longitudinal loop 33, such as the loop 33*c*. The upper loops 33*a* and 33*c* engage and are hooked proximate to the intersection of two adjacent slivers 20*a,* 20*c*. Similarly, the second upper loop 33*b* links with the first upper loop 33*a* over the intersection location of the adjacent slivers 20*a,* 20*b*.

The bottom of the pad 10 is illustrated in FIG. 5*b*. A plurality of lower loops also comprise the web 30, such as for example the first and second lower loops 33*d* and 33*e*, respectively, which are shown in a preferred configuration hooked in a linking engagement with the linking intersection positioned over the center of a sliver 20. This offsetting of the lower loop intersections relative to a sliver and relative to upper loop intersections, as illustrated with respect to the engaging portions of the lower loops 33*d* and 33*e,* facilitates compression and the retention of compressive forces to maintain the pad 10, including when the pad 10 is used with an iron. For example, the handling of forces exerted by ironing an article of clothing, especially when moving an iron across the pad 10 (or cover thereon), is facilitated by the web 30 and arrangement of the slivers 20 in compression with the loops 33, and is further facilitated by the positioning of the loops, such as those upper loops 33*a*, 33*b*, 33*c* illustrated in FIG. 5*a* positioned at the intersection of the slivers 20*a* and 20*b*, and 20*a* and 20*c*, respectively; and those lower loops 33*d* and 33*e* shown in FIG. 5*b*.

The loops 33*d* and 33*e* preferably may be formed from a continuation of the thread or threads which form the upper loops, such as those upper loops 33*a* and 33*b* shown in FIG. 5*a*. The compression of the web 30 on the slivers 20 is facilitated by the formation of the loops 33. For example, the tensioning of a thread or threads forming the loops 33 facilitates compression of the slivers 20 by tightening the web 30.

FIG. 5*b* shows the underside or bottom 5*l* of the pad 10 in a partial view enlarged to show the web 30. The web 30 is shown holding and maintaining the slivers 20 in a compressed condition. The web 30 is illustrated constructed in accordance with a preferred embodiment of the present invention wherein a plurality of longitudinal lower loops, including for example those 33*d*, 33*e*, 33*f*, 33*g*, and 33*h*, are arranged in substantially perpendicular relation to the slivers 20. The slivers 20 are transversely disposed in relation to the pad length.

Referring to the top view of the pad 10 shown in FIG. 5*a*, there is illustrated a plurality of formed loops 33 which are interconnected with successive loops 33 to form a network or web 30. Preferably, the loops 33 are formed by the thread which is woven in the configuration shown and is disposed on opposite sides of a sliver 20 so that the thread partially or fully is encircles the sliver 20 and holds the sliver 20. Referring to FIG. 4, the feature is illustrated where a plurality of adjacent slivers 20 are held by threads forming the web 30.

Referring to FIG. 5*a*, a preferred embodiment of the formed loops 33 is illustrated. In connection with the third upper loop 33*c* there is shown, for illustration purposes, a loop first portion, portion "A", which with a loop second portion, portion B, forms the third upper loop 33*c*. The thread portion B forming the loop 33*c* passes between adjacent slivers 20*c* and 20*a* where it continues from the top of the pad to the bottom of the pad 10, and forms a lower loop 33*f* on the bottom of the pad 10, as shown in FIG. 5*b*.

Referring to FIG. 5*b*, the continuation of the loop 33*f* is illustrated. Portion B, which comprises the lower loop first portion of loop 33*f*, with lower loop second portion C (which preferably is a continuation of portion B but designated portion C for illustrative purposes), forms the loop 33*f*. Preferably, the loop 33*f* is formed and interconnects with a longitudinally engaging loop 33*g* of the lower loop series 53 to continue the formation of the network or web 30. The lower loop 33*g* formed with the continuation of portion B facilitate the holding of the sliver 20*c* in place.

Referring to the continuation of portion C from loop 33*f*, the portion C crosses the portion B of loop 33*f* and continues toward the intersection of the slivers 20*a* and 20*b* underlying a portion of the loop forming lower loop 33*h*. The portion C returns to the top 50 of the pad 10 (FIG. 5*a*) to form an upper loop 33*i*. Other loops 33 are preferably formed in the same manner to provide the web configuration described in connection with the loops 33*a*–33*i*.

FIG. 5*b* shows a thread portion C in broken-line representation. This thread portion C is illustrated positioned below the lower loop 33*h*. The thread portion C then continues, as shown in FIG. 5*a,* to form an upper loop 33*i*. Although not shown, it will be understood that there preferably may be strands underlying other loop portions, which continue to form additional loops 33 to comprise the web 30. Preferably, as shown in FIGS. 3 and 4, and in connection with the sliver 20*a* in FIG. 5*b,* the strand portions forming the web loops 33 encircle the slivers 20.

As illustrated in FIGS. 5*a* and 5*b,* the web 30 is formed with threads which are configured into interconnecting loops 33. One or more threads can be used to comprise the web 30. In a preferred configuration of the invention, the web 30 preferably comprises offsetting loop intersections, such that the loops 33 engage with other loops 33 at different locations on the top and bottom planes of the adjacent slivers 20. In other words, in a preferred configuration, the upper loops formed on the top of the pad 10, such as, for example, upper loops are shown interconnecting with other upper loops over the intersection of adjacent slivers 20, whereas lower loops on the bottom of the pad 10 are shown interconnecting with other lower loops at a location below a sliver, such as at the middle of a sliver.

The portions of the threads forming the loops, as illustrated and exemplified by the lower loop 33*f* shown in FIG. 5*b* and described herein, preferably, cross at their intersection, I (see FIG. 3), to provide a further distribution of a retaining force for facilitating the holding and compressing of the slivers 20 held by the web 30.

The above described web configuration facilitates the compression of the slivers 20 in adjacent relation to one another to form the pad 10. The web 30 maintains the arrangement of the slivers 20 during the time when the pad 10 is installed on an ironing board 100, and when the pad 10 is in use under an article which is being ironed thereon, including where a cover has been placed over the pad 10. Preferably, a cover is installed on the ironing board pad 10, and the article placed on the cover surface for ironing.

The method of making a pad in accordance with the invention preferably comprises providing heat resistant material which may comprise heat resistant thread and beat resistant fibrous material. The fibrous material is provided in the form of slivers, as discussed above in connection with a preferred embodiment of the invention. Preferably, the method also includes providing a binding material for binding the edges of the pad. The binding material also comprises a heat resistant material, since it, on occasion, may come in contact with the heat from the surface of an iron.

The method of making a pad is preferably carried out using an apparatus, such as a frame on which one or more of the components comprising the pad are supported while the pad is being constructed. Examples of such apparatus are commonly referred to as looms. The frame or loom preferably supports the fibrous material, such as, for examples, the slivers, and holds the thread in a manner to facilitate the formation of the web loops, as described herein. It is known to provide machines which will place thread in an arrangement for creating a fabric. Such machines are generally referred to as looms. In accordance with the present method, a loom is utilized with the threads and slivers to configure them into a pad, such as the pad 10 shown and described herein. For example, in accordance with the present method, the loom or frame preferably supports the fibrous material or slivers and holds the thread in a manner to facilitate the formation of a web of loops, as described herein.

For example, the loom may comprise a weaving machine with lifters for moving the thread. The loom, for example may be provided with a device driving the lifters, wherein lifters are provided configured as a plurality of shaped-needle rows carried on rods, and being capable of moving upwardly and downwardly to configure the web 30 by forming the loops 33.

Turning to an example of carrying out the method, the slivers are placed on the loom and the thread is maneuvered by one or more elements of the loom apparatus. The slivers are supported on the loom to form a web, such as, for example, the web 30 described herein. Additional slivers are placed adjacent to the first sliver, and the web is further formed by maneuvering the thread to hold the additional slivers which are placed adjacent to the other slivers. These steps are repeated and continue until the desired size for the pad material is achieved.

It is understood that a single pad can be produced or, alternately, a quantity or area of pad with a plurality of slivers held by a web can be produced and later cut into smaller units and bound into individual pads.

Preferably, a binding material is applied to secure the web at the thread ends or perimeter of the pad. The slivers are maintained by the web in compression. As illustrated, the web is formed by a plurality of longitudinally arranged rows of loops which are transversely spaced. The loops are formed on the top and bottom of the slivers so that the slivers are maintained to minimize bunching or wrinkling, even against the pressure extruded by an ironing apparatus moving across the pad 10, or over a cover covering the pad 10, when ironing an article.

The method can be carried out by forming a first loop and passing a thread through the loop and forming a next successive loop which interconnects with the first loop. Preferably, as the loops are formed, the thread is positioned to partially or fully encircle a sliver. This facilitates maintaining compression of the sliver when further loops are formed. The interconnected loops may be tensioned as they are formed to maintain the slivers in a compressed condition.

The drawing figures, a preferred embodiment of a pad 10 is shown. For example, to carry out the method, a first loop may link with a second loop which is being formed. The second loop may pass through the first loop and link with the first loop. The portions forming the second loop then interconnect with other loops and form additional loops. This process continues until the web 30 is formed to hold the slivers.

These and other advantages of the present invention will be understood from a reading of the summary of the invention, the brief description of the drawing figures, the detailed description of the preferred embodiments, the drawings and the appended claims. Other modifications may be made within the spirit and scope of the invention.

What is claimed is:

1. An ironing pad comprising:

a plurality of fibrous elements arranged adjacently and held together by a web to form a pad having a first side and a second side, said web comprising a plurality of loops, including a first plurality of loops provided on said first side of said pad, and a second plurality of loops provided on said second side of said pad, wherein the first plurality of loops interconnect in the area above the lateral intersection of adjacent slivers, and wherein the second plurality of loops interconnect in the area above a sliver located between two lateral intersections of adjacent slivers.

2. The pad of claim 1, wherein said pad has a front end and a rear end, a top surface and a bottom surface, wherein said fibrous elements are disposed in transverse relation between said front end and said rear end of said pad.

3. The pad of claim 1, wherein said fibrous elements are held in compressive engagement with said heat resistant thread in a web.

4. The pad of claim 1, wherein the fibrous elements are maintained in a compressed condition by said web.

5. The pad of claim 4, wherein said fibrous elements are comprised of cotton.

6. The pad of claim 4, wherein said web comprises a heat resistant material.

7. The pad of claim 6, wherein said web comprises a longitudinal weave of lassos which hold said fibrous elements in adjacent relation to one another and which constrict said fibrous elements to maintain said elements in a compressed condition.

8. The pad of claim 4, wherein said web comprises a plurality of loops forming a network to hold said plurality of fibrous elements in compressive adjacent relation to one another.

9. The pad of claim 8, wherein said web comprises a network of threads which are woven to form a plurality of loops wherein each said loop encircles a fibrous element, and wherein said plurality of loops are spaced apart from each other.

10. The pad of claim 9, wherein said web comprises a longitudinally disposed series of loops.

11. The pad of claim 10, wherein said fibrous elements are arranged in transverse relation to said longitudinal loops.

12. The pad of claim 9, wherein a plurality of loops are each comprised of a first loop strand portion and a second loop strand portion, said first loop strand portion and said second loop strand portion forming a loop end, wherein for a plurality of said plurality of loops the second strand portion links with a loop other than the loop formed thereby and returns in the direction of the formed loop, and wherein the first strand portion extends longitudinally in the opposite direction of the second strand portion which returns.

13. A method for making an ironing board pad having a first side and a second side, comprising the steps of:

providing a plurality of heat resistant fibrous elements;

arranging said plurality of fibrous elements adjacently;

compressing said fibrous elements with a plurality of loops, including a first plurality of loops provided on said first side of said pad, and a second plurality of loops provided on said second side of said pad;

interconnecting said first plurality of loops at a location above the lateral intersection of adjacent slivers; and interconnecting said second plurality of loops at a location above a sliver and between two lateral intersections of adjacent slivers.

14. The method of claim 13, wherein said plurality of heat resistant fibrous elements comprise elements which comprise rod-like configurations, and wherein the step of arranging comprises arranging the rod-like fibrous elements adjacently, and wherein the step of compressing said fibrous elements is carried out by winding a heat resistant thread around said fibrous element to hold said fibrous element.

* * * * *